United States Patent [19]

Dukes et al.

[11] 4,027,813

[45] June 7, 1977

[54] TUBE SEPARATOR

[75] Inventors: Glenn V. Dukes, Cadillac; Thomas L. Stroh, Lake City, both of Mich.

[73] Assignee: Cadillac Rubber & Plastics, Inc., Cadillac, Mich.

[22] Filed: June 17, 1976

[21] Appl. No.: 697,207

[52] U.S. Cl. ..... 225/97; 225/100

[51] Int. Cl.[2] ..... B26F 3/02

[58] Field of Search ..... 225/97, 100, 101, 102, 225/1; 83/4

[56] References Cited

UNITED STATES PATENTS

| | | | |
|---|---|---|---|
| 1,072,055 | 9/1913 | Straight | 225/100 |
| 3,507,429 | 4/1970 | Cunningham et al. | 225/97 |

*Primary Examiner*—Frank T. Yost

*Attorney, Agent, or Firm*—McGarry & Waters

[57] ABSTRACT

A tube separator has two blocks with vertically and linearly aligned protrusions to which joined tubes are attached for separation into individual tubes. The protrusions are interdigitally arranged when the blocks are adjacent each other. A chain drive engages one block and pulls it from the other block which is locked in a fixed position. A guiding means maintains the blocks in an upright position. An ejecting means for separating the tubes from the protrusions engages the driven block and ejects the tubes from the protrusions. The fixed block is pushed by a driven block from a succeeding cycle and also engages the ejecting means for removing the tubes from the protrusions. The chain drive returns a block along the guide means so that an operator may reuse them with other tubes.

24 Claims, 10 Drawing Figures

TUBE SEPARATOR

BACKGROUND OF THE INVENTION

1. Field of the Invention

This invention relates to a tube separator which uses a pair of blocks each having vertically and linearly aligned and interdigitated connectors which connect to joined tubes for separating the joined tubes into individual tubes.

2. Description of the Prior Art

A variety of tubes such as vacuum tubing, fuel emission tubing and fuel lines are commonly vulcanized in groups where the tubes are aligned parallel and in contact with each other. During the vulcanization process, the tubes are joined together along the longitudinal edges thereof.

Heretofore, the tubes have been separated from each other manually. This method is slow, tedious and relatively expensive.

Automatic separators would greatly improve the efficiency of separating the joined tubes. Automatic separator have been previously employed to separate various other items such as strips of paper, sheets of paper, and other paper-thin materials. One such separator has been disclosed in the U.S. Pat. No. 3,507,429 to Cunningham, issued on Apr. 21, 1970. The Cunningham reference discloses the use of a plurality of pairs of extending fingers. The fingers are attached to a chain which is trained around a sprocket. An individual finger of each pair of fingers is attached to an adjacent link and lies adjacent to the other finger of the same pair. As the chain moves around a convex portion of its path the fingers separate, thus separating an individual carrier from the strip material. The separators however are not capable of separating joined tubes into individual tubes.

SUMMARY OF THE INVENTION

According to the invention, a separator element has a side toothed edge and fastening elements extending frontwardly from the toothed edge of the separator element. A second separator element has a correspondingly toothed edge where each tooth of one separator element fits within a space of another separator element to form an interdigital connection. Each tooth of the second separator element also has fastening elements extending frontwardly. The fastening elements are linearly aligned. Preferably, the fastening elements are finger-like protrusions extending horizontally. The protrusions are preferably vertically and linearly aligned when interdigitated.

When the blocks are together, the unseparated tubes can be loaded onto the fastening elements whereby each fastening element is secured to an individual tube. In a specific embodiment, the fastening elements are finger-like protrusions which desirably snugly fit within the tubes to minimize any slippage of the tube from the finger-like protrusion.

The separator elements engage a means for separating the separator elements (hereinafter referred to as blocks) apart from one another a sufficient distance to completely separate the joined tubes into individual tubes. The separator means is operably supported by a frame.

Desirably, the means for separating the blocks is a drive chain having spaced lugs which engage the first (or driven) block and drives the driven block away from the second (or free) block which is fixed by a locking means. The locking means is desirably a separator plate having slotted apertures therethrough. Prongs which are connected to the free element block are positioned through the apertures and engage the separator plate. As the drive chain drives the first block forward guide means, preferably in the form of rails, engage the block and maintain its preferably upright position. Preferably, both the drive chain and the guide rail are continuous loops to enable a return of the drive block to the separator means.

In one specific embodiment, a pair of axially aligned guide rails are fixed to the frame wherein the blocks are situated between them so as to be guided by both rails. Preferably, a drive chain is adjacent to each guide rail and aligned with the other chain drive. Preferably, each of the two drive chains engages the drive block so as to exert an evenly distributed force on the block and to minimize any angular stress on the driven block. Preferably, a control means controls the speed, direction and distance of the drive chains.

Preferably, the chain is supported by a drive sprocket at one end and a free sprocket at another. The sprockets are relatively far apart to cause the chain to have an elongated loop configuration. The drive sprocket engages a motor which drives the drive chain.

Desirably, the invention is capable of continuous operation without interruption. To achieve this end, the drive chain recedes from the guide rail at a point before the separator plate and is kept in a receded position until aligned with the separator plate. When in the receded position, the chain is disengaged from the driven block so as to allow the free block and driven block to be in a rest position while the drive chain continuously moves. The blocks can be loaded with joined tubes while the chain is running. The drive chain will engage the driven block when the driven block is aligned in front of the separator plate and the free block is engaged with the separator plate.

Preferably, after the tubes are separated, an automatic removing means for removing the individual tubes from the finger-like protrusions engage the blocks. The removing means desirably comprises an ejector cam which engages a spring loaded back bar which connects to an ejector plate on the blocks. The ejector plate is fitted on the front surface of the block and has apertures through which the finger-like protrusions protrude. As the ejector cam engages the ejector plate, the ejector plate is pushed forward to the tips of the protrusions and the tubes are pushed off the finger-like protrusions. After the block passes the ejector cam, the ejector plate returns to its original position. The driven block follows the drive chain and around the sprockets, and is cycled back to the receded portion of the chain when it disengages from the driven block.

After the tubes are separated, a means for disengaging the free block from the separator plate is actuated. A succeeding pair of blocks then engage the separator means. The free block from the preceding cycle is pushed by the driven block of the succeeding cycle. The free block engages the removing means in the same fashion as the driven block. Afterwards, the free block is pushed around the sprockets and back to the recessed position of the chain. The driven block of the succeeding cycle disengages from the chain drive and the two moving blocks come to rest. At this position, the free block pairs with its originially paired driven block and the protrusions of the two block are again interdigitated.

Preferaly, a friction brake engages the blocks immediately after the driven block disengages from the chain.

Preferably, the pair of blocks are automatically delivered from the rest position to a load position where the tubular group is attached to the blocks. Preferably, the delivery means has a hook that is spring mounted on a slidable bar. The slidable bar is operably connected to an air cylinder which is in turn mounted on the frame. The hook engages the blocks and the slide bar moves the hook and blocks along the guide rail until a pair of blocks are aligned in front of a securing plate. Preferably, the free block has a lug which engages the hook so as to allow the delivery means to move the free block which in turn pushes the driven block.

The securing plate is slidably attached to the frame at the recessed portion of the chain drive. The securing plate is preferably operably mounted to an air cylinder with a slidable bar. The securing plate has a forward and rearward position. When in its forward position, the securing plate engages and secures the free block in a fixed position whereby an operator may attach the tubular group onto the protrusions. The securing plate prevents the free blocks from inconveniently sliding while the operator is loading the joined tubes onto the blocks.

The pair of blocks, after being loaded, are preferably manually moved along the guide rail to ready position. Preferably, a second delivery means moves the blocks from the ready position to the separator means. Desirably, the delivery means has a hook, slidable rod and air cylinder mounted onto the frame in the same fashion as the first delivery means.

In a specific embodiment, actuators are employed along the guide means to actuate and deactuate the securing plate and the separation plate. An engaging means mounted on the driven block actuates an actuator mounted on the guide means adjacent the securing plate. The engagement of the actuator actuates the securing plate to move forward and secure the pair of blocks. The securing plate disengages from the blocks upon actuation of a manual actuator which also actuates the hooking means to pull another pair of blocks to the securing plate.

A second actuator is mounted preferably on the guide means adjacent the separator plate and operably coupled thereto. Preferably, the separator plate is slidably mounted on the frame and operably connects to an air cylinder in the same fashion as is the securing plate. The engaging means mounted on the driven block engages the actuator which actuates the separator plate to move forward and engage the prongs of the free block. A deactuator means is mounted on the guide means away from the separator plate. After the blocks are separated and the joined tubes are separated into individual tubes, the engaging means on the driven block engage the deactuator means which disengages the separator plate from the free block.

This invention provides for an easily operable apparatus and provides for an efficient means to separate joined tubes into individual separate tubes. An operator can conveniently load a group of joined tubes at a single position and let the invention separate the tubes and automatically eject them. The invention operates in a way so that the operator may have a pile of joined tubes and can without moving to a different area end up with a pile of individual tubes.

The invention also has many safety advantages. The operator does not need to continuously feed groups of tubes to cutters which poses a danger to the hands and limbs of the operator. Instead, the operator loads the tubes on the exterior part of the invention when the separator elements are at rest. The invention separates the tubes without any further manual assistance from the operator.

DETAILED DESCRIPTION OF THE PREFERRED EMBODIMENTS

Figure 1:
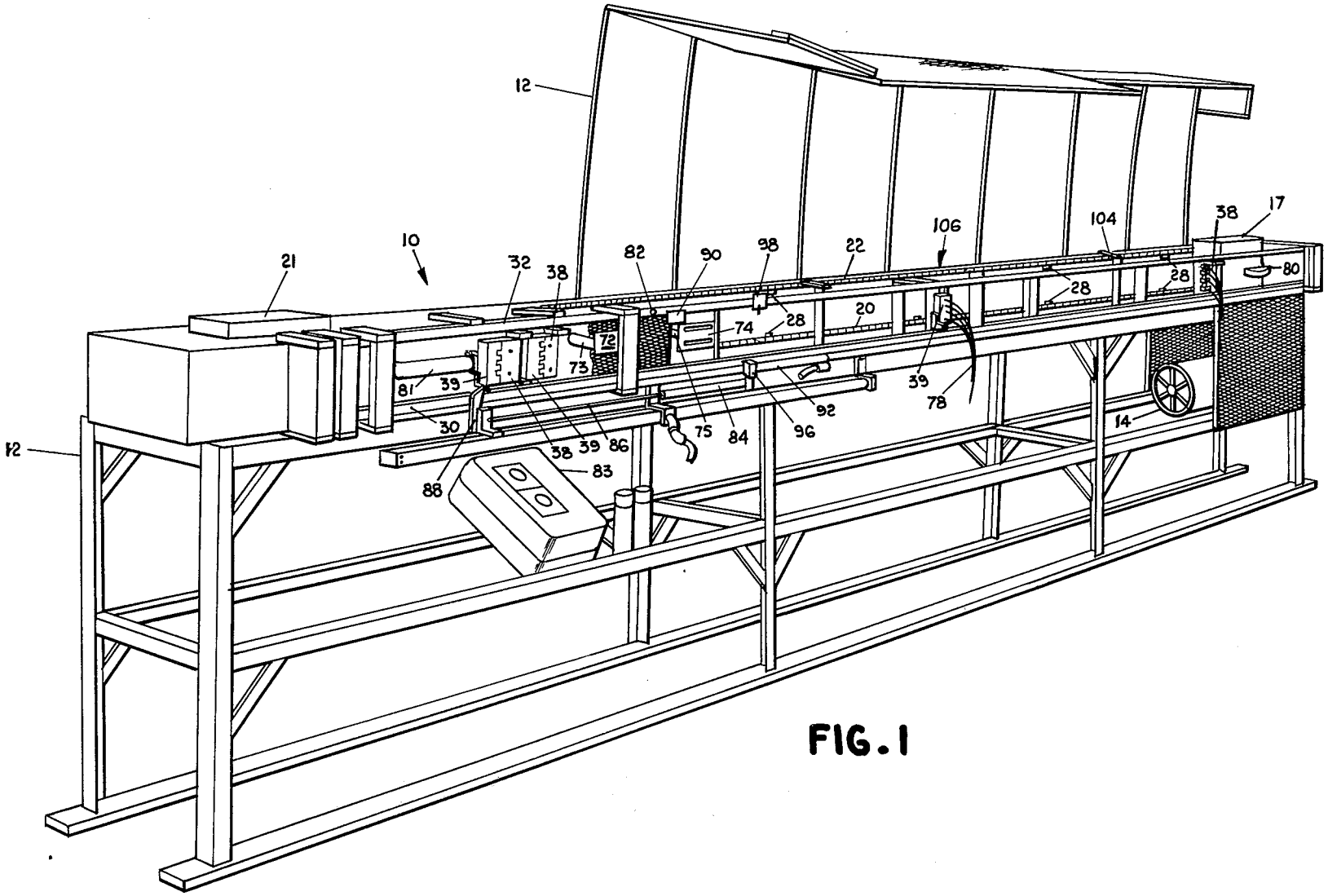
FIG. 1 is a perspective view of a tube separator according to the invention.
Figure 2:
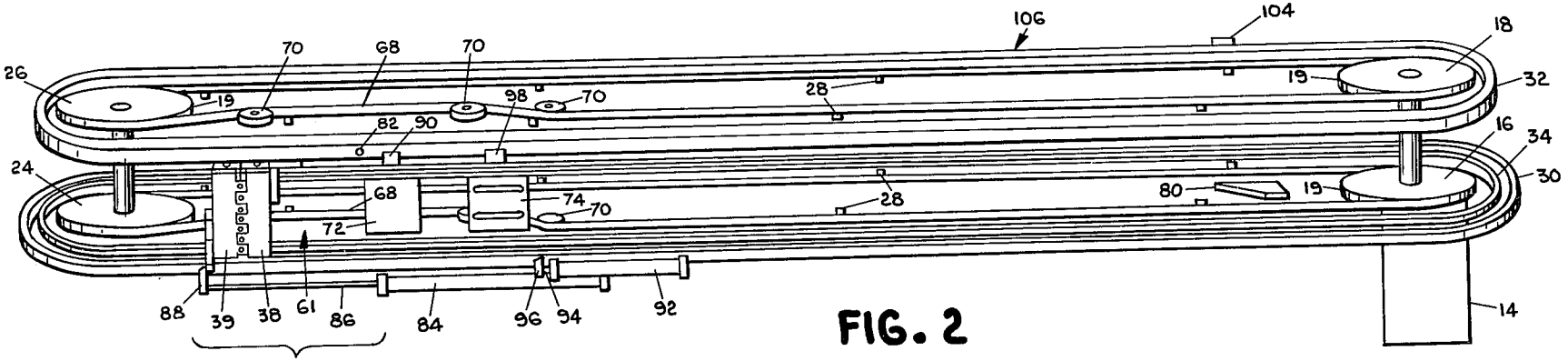
FIG. 2 is a simplified fragmentary perspective view of the chain drive, blocks and guide rails of the tube separator shown in FIG. 1.

Referring now to FIGS. 1 and 2, the tube separator 10 is constructed on a frame 12 at a convenient height at which an operator can either sit or stand. At one end, a motor 14 operably connected to a power supply is rigidly fixed to the frame 12 and operably connected to vertically aligned drive sprockets 16 and 18. A housing 17 encloses the drive sprockets 16 and 18. The drive sprockets have teeth 19, which engage aligned drive chains 20 and 22. The drive chain 20 is trained around drive sprocket 16 and drive chain 22 is trained around drive sprocket 18. At the other end of the tube separator 10, the drive chains 20 and 22 are trained around the free wheel sprockets 24 and 26 respectively. The free wheel sprockets are enclosed in a housing 21. A control unit 83 is operably connected to the motor 14 to slow, reverse, stop and limit the motor actions upon the drive chains 20 and 22.

Interspersed throughout the chain are attached lugs 28. The lugs 28 attached to the lower chain 20 extend upward and the lugs 28 attached to the upper chain 22 extend downward. The lugs 28 on the two chains are aligned vertically. Fixedly attached to the frame 12 are a lower continuous and endless guide rail 30 and an upper, continuous and endless guide rail 32. The lower guide rail 30 has a channel 34 running along its top surface. The upper guide rail 32 has a channel 36 running along its bottom surface.

Figure 5:
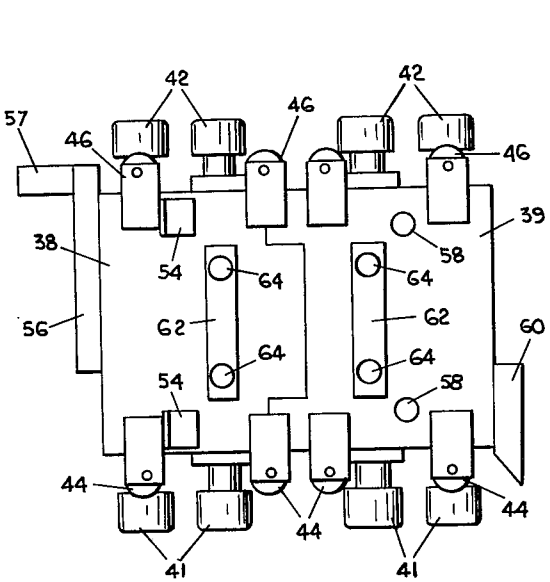
FIG. 5 is a rear elevational view of the pair of blocks shown in FIG. 3.
Figure 4:
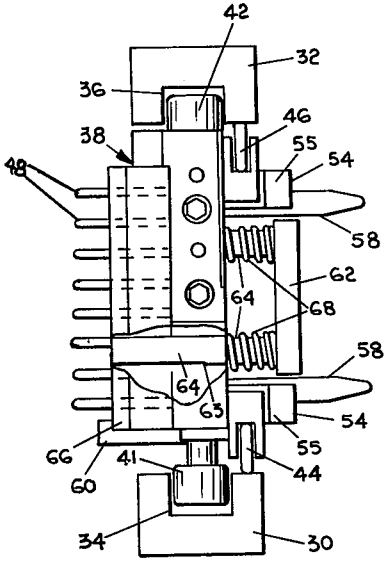
FIG. 4 is a side elevational view of the blocks shown in FIG. 3.

Placed within the channels 34 and 36 are six pairs of blocks; each pair having a driven block 38 and a free block 39. Each block has two pairs of rollers, a lower pair 41 and an upper pair 42 which are positioned respectively in the lower and upper channels 34 and 36. As shown in FIG. 4 and FIG. 5, each block 38 and 39 has two pairs of inside rollers 44 and 46. Rollers 44 contact the upper surface of lower guide rails 30 while rollers 46 contact the bottom surface of upper guide rail 32.

Figure 3:
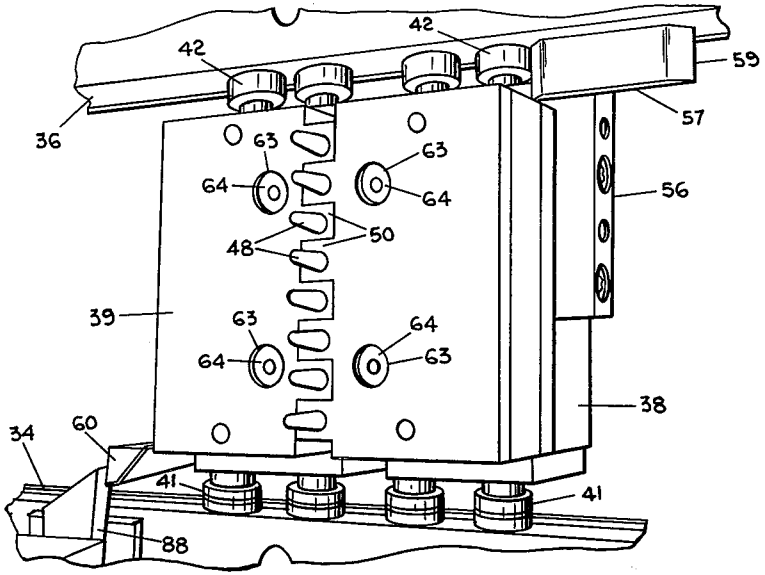
FIG. 3 is an enlarged fragmentary perspective view showing a pair of tube separating blocks of the tube separator shown in FIG. 1.

Referring now to FIG. 3, positioned at the front surface of blocks 38 and 39, are interdigital protrusions 48 which are attached to toothed extensions 50 of the blocks 38 and 39. The toothed extensions 50 are of uniform size and of rectangular shape. The toothed extensions 50 interweave to form a flush vertical joint between the two blocks 38 and 39. Each block has four toothed extensions 50. Each tooth has one finger-like protrusion 48 extending out perpenducular to the front surface of the toothed extensions 50. Each protrusion 48 is vertically and linearly aligned with another on the same block. When the toothed extensions are interdigitated, the protrusions of the pair of blocks are of the same size, vertically and linearly aligned, and evenly spaced apart.

Figure 6:
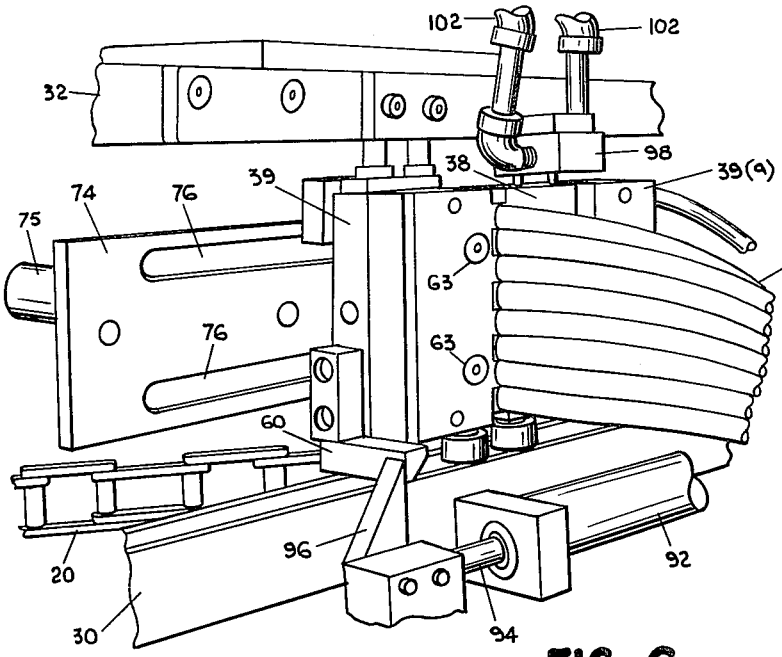
FIG. 6 is an enlarged fragmentary perspective view of the tube separator in a loaded and start position.

As shown in FIGS. 3 and 6, the protrusions 48 are sufficient size to securely attach joined tubes 52. The protrusions are spaced apart to be aligned with the hollow ends of the joined tubes 52. The protrusions 48 are sufficiently thick to snugly fit within the hollow ends of joined tubes 52. The protrusions are sufficiently long to extend into the hollow ends of joined tube 52 and support the joined tubes.

As shown in FIGS. 3, 4 and 5, driven block 38 has two lugs 54 extending from its rear surface. The lugs 54 are vertically aligned and extend horizontally rearwardly. The lug has a horizontally tapered surface 55. At the side edge opposite the protrusions 48, block 38 is connected to a side bar 56 which has an upper extension 57. The extension 57 is horizontal and slightly elevated above block 38. The end of extension 57 is tapered at 59 to a back edge.

Figure 7:
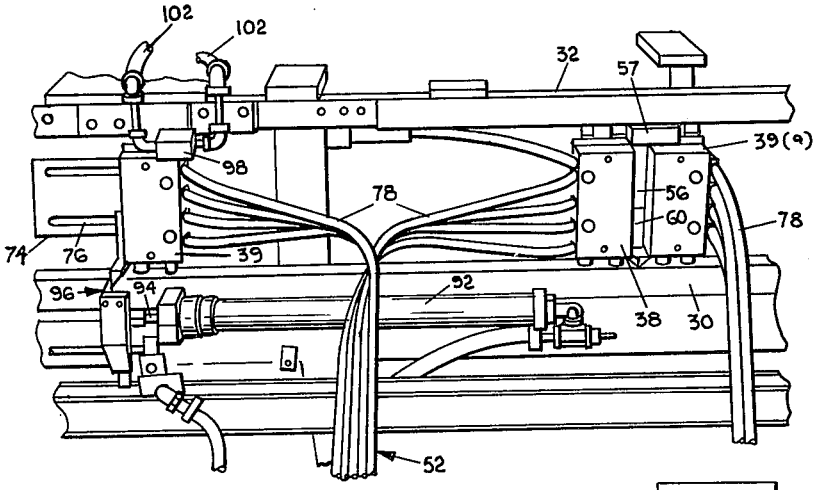
FIG. 7 is an enlarged fragmentary perspective view of the tube separator showing the separation of the joined tubes into separate individual tubes.

Free block 39 has two prongs 58 extending from its back surface horizontally to a tapered point. The prongs 58 are vertically aligned and extend horizontally rearward. The prongs are positioned vertically closer to the center of the block than are lugs 54 on block 38 but extend more rearwardly than lugs 54. Attached to the side surface of the block 39 opposite the protrusions 48 is lug 60 which extends below and more forward than block 38 and 39. Lug 60 is tapered toward its bottom away from the protrusions 48. As shown in FIG. 7, lug 60 fits underneath side bar 56 when the free block 39 is to the right of driven block 38 of a succeeding cycle. Lug 60 and side bar 56 keep blocks 38 and 39 apart and have the same width so as to have flush contact with the side surface of the adjacent block.

Figure 10:
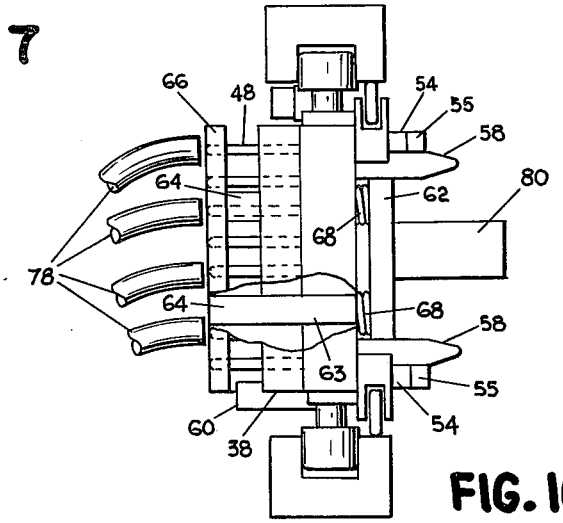
FIG. 10 is a side elevational view of the tube separator blocks as shown in FIG. 3 in their ejecting position.

Each block has a cylindrical back bar 62 which is attached to two horizontal rods 64 which extend through apertures 63 of the blocks 38 and 39. The rods 64 connect to an ejector plate 66. Ejector plate 66 covers the full front surface of each block but has apertures to allow the protrusions 48 to extend therethrough. Springs 68 are placed around each rod 64 from the back surface of each block to the back bar 62. As shown in FIG. 10, back bar 62 can be depressed thereby extending ejector plate to the outer tips of the protrusions 48. When the pressure upon back bar 62 is released, the springs 68 will return the bar to its rest position as shown in FIG. 4.

Referring now to FIG. 2, the two chain drives 20 and 22 are parallel to the respective guide rails 30 and 32 except that chain drive 20 and 22 has a receded section 68, wherein the chain drive maintains a greater distance from the respective guide rail. Several rollers 70 are fixed in position on the platform and guide the drive chains 20 and 22 through the receded portion. The receded portion is of sufficient length to allow six pairs of blocks to rest therein in a magazine section 61.

Between the receded portion of the chain drive 20 and 22 and the guide rail 30 and 32 is securing plate 72.

As shown in FIG. 1, securing plate 72 is attached to a slidable air cylinder 73 and is capable of sliding forward toward guide rails 30 and 32 or receding toward chains 20 and 22. When the pair of blocks 38 and 39 are positioned in front of the securing plate 72, the securing plate 72 slides forward and engages the block 39 at the tips of prongs 58. The engagement prevents block 39 from sliding along the guide rails 30 and 32. When the securing plate 72 engages block 39, the joined tubes 52 may be loaded onto the aligned protrusions 48 of blocks 38 and 39 without the block 39 separating or sliding away from block 38 which can be manually held against block 39.

The securing plate 72, when in the receded position does not engage the block 39. The blocks are free to be moved down the guide rails as depicted in the Figures from the left to the right.

Positioned to the right of securing plate 72 is separator plate 74. Separator plate 74 is placed where the drive chains 20 and 22 extend from their receded position 68 to a position adjacent guide rails 30 and 32. Separator plate 74 has two horizontal slots 76 aligned with prongs 58 extending from the back of block 39. The separator plate 74 is attached to a slidable cylinder 75 which can move the separator plate 74 from adjacent the guide rails to a receded position away from the guide rails. When the pair of blocks 38 and 39 are positioned in front of the separator plate 74, the plate 74, when in a forward position, will engage the prongs 58 of block 39 through its slots 76 but not engage block 38. When free block 39 is engaged by separator plate 74, driven block 38 is adjacent the drive chains 20 and 22.

Figure 8:
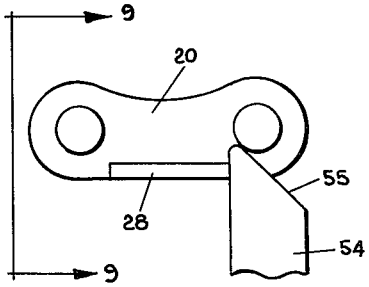
FIG. 8 is an enlarged and fragmentary plan view of a drive chain as shown in FIG. 2 engaging the driven block.
Figure 9:
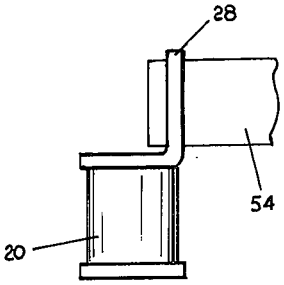
FIG. 9 is a side elevational view of FIG. 8 seen along lines 9—9 of FIG. 8.

When the drive chain proceeds forward, as illustrated in the figures in a counterclockwise motion, lugs 20 to drive chains 20 and 22 will engage the lugs 54 on driven block 38. A detailed view of the lugs 28 engaging lugs 54 is shown in FIG. 8 and FIG. 9. Lug 28 engages the flat side opposite the tapered side 55 of lug 54. Block 38, engaged by the drive chains, proceeds down guide rails 30 and 32 and is separated from free block 39 which has no lugs engaging the drive chain. Block 39 instead is confined within the slots 76 of separator plate 74. As shown in FIG. 7, the alternating protrusions 48 of the two blocks, when separated, tear the joined tubes 52 into indivudual tubes 78.

As the driven block 38 is driven along guide rails 30 and 32, at one end before the guide rail curves around sprockets 16 and 18, block 38 engages ejector cam 80. Ejector cam 80 is fixed to the frame 12. Ejector cam is tapered toward the direction of the separator plate 74 and has a forward edge aligned slightly behind the guide rails 30 and 32. As the driven block 38 passes by ejector cam 80, the cam 80 engages back bar 62 and causes it to move toward block 38. As shown in FIG. 10, ejector plate 66 is then extended forward to the tips of the protrusions 48 thereby ejecting the individual tubes 78 from the protrusions.

Block 38 then is driven by the drive chains 20 and 22 around sprockets 16 and 18 and back to the receded portion 68 of the drive chains where the lugs 28 and 54 disengage from each other. A brake 81 is mounted on the frame 12 at the point where the chain drive recedes. The brake 81 engages the back bar 62 and slows down block 38 to a rest position in the magazine section 61.

To provide for ease of operation, the tube separator 10 has various switches operably connected to a power supply. The switches automatically engage and disengage the plates 72 and 74 and move the blocks 38 and 39 into position for engagement with said plates.

Referring to FIGS. 1 and 2, manually operative actuator 82 attached to guide rail 32 activates an air cylinder 84 which extends a slide bar 86 having a one-way spring loaded lug 88 connected to its end. When the slide bar extends, the spring loaded lug 88 slides under side lugs 60 of blocks 39. After extending, the slide bar 88 is then retracted by cylinder 84. The spring loaded lug 88 engages the side lug 60 when retracting and pulls the pairs of blocks that are in the magazine section 61. The end of cylinder 84 is aligned under securing plate 74. The lug 88 brings one pair of blocks 38 and 39 into alignment with securing plate 72.

An actuator 90 is attached to top guide rail 32 and aligned in front of securing plate 72. The top extension 57 of side bar 56 engages the actuator 90 as block 38 approaches it. The actuator 90 activates the air cylinder 73 which extends securing plate 72 forward to engage the tapered ends of prongs 58 of block 39. The actuator 90 also stops the retraction of slide bar 88. The air cylinder 73 keeps securing plate 72 engaged with block 39 so the protrusions 48 of blocks 38 and 39 may be loaded with the joined tubes 52. The actuation of actuator 82 deactivates air cylinder 73, thus releasing the securing plate 72. The actuator 82 simultaneously activates air cylinder 84 to extend and subsequently retract and bring another pair of blocks into alignment with the securing plate 72. When the securing plate 72 is disengaged from prongs 58, the operator can manually slide loaded blocks 38 and 39 to a ready position between the securing plate 72 and separator plate 74.

Referring to FIGS. 2 and 7, an air cylinder 92 having a slidable bar 94 and spring loaded lug 96 similar to those of air cylinder 84 is positioned externally and adjacent to guide rail 30 and aligned with the right edge of separator plate 74. The extendible slidable bar 94 constantly extends to the ready position of the blocks 38 and 39 between the securing plate and separator plate and thereafter retracts. When the blocks are in the above ready position, the lug 96 will engage lug 60 of block 39 on the retraction cycle of the cylinder 92 and slide blocks 38 and 39 to an aligned position with separator plate 74.

Referring back to FIGS. 1 and 2, an actuator 98 is attached to guide rail 32 and aligned in front of separator plate 74. The actuator 98 activates the air cylinder 75 which extends separator plate 74 forward. As detailed in FIGS. 6 and 7, air tubes connected to actuator 98 lead to air cylinder 75. Actuator 104 as shown in FIGS. 1 and 2, is an actuator of the same type as actuators 90 and 98. It is located on the upper guide rail 32 on the return side 106 near sprockets 18. When top extension 57 of block 38 passes by, it engages actuator 104 which deactivates cylinder 75. Separator plate 74 then attains a receded postion and is disengaged from free block 39. Driven block 38, when pulled into position to be engaged with drive chains 20 and 22, pushes ahead of it any free block 39(*a*) from a previous cycle. As shown in FIG. 7, when the driven block 38 is engaged with the chains, free block 39(*a*) precedes it. Free block 39(*a*) will engage the ejector cam in the same manner as driven block 38 so as to have individual tubes 78 ejected from the protrusions 48. Free block 39(*a*) also engages brake 81 in the same manner as block 38 and comes to rest.

The tube separator 10 may be operated by a single operator. When the tube separator is connected to a power supply, the operator presses actuator 82. Actuator 82 will actuate air cylinder 84 that will extend slide bar 86 and lug 88 and then retract the two back. Lug 88 will engage lug 60 of block 39 and pull forth a series of blocks in magazine 61. When a pair of blocks 38 and 39, align with securing plate 72, actuator 90 will be engaged with block 38. Air cylinder 84 will stop retracting and securing plate 72 will extend forth and engage prongs 58 of block 39. The operator then holds block 39 against block 39 and loads joined tubes 52 into protrusions 48.

The operator will again press actuator 82 which disengages the securing plate 72 from prongs 58. The operator will move the pair of loaded blocks a few inches to his right to a ready position and load another pair of blocks which were brought to securing plate 72 when he pressed 82 for disengaging securing plate 74.

The pair of loaded blocks will then be engaged by constantly moving lug 96 attached to air cylinder 92. When the blocks are aligned with separator plate 74, block 38 engages actuator 98 which extends separator plate 74 forward to positively engage prongs 58 of block 39 within slots 76. Block 38 is in position to engage lug 28 on drive chains 20 and 22 which are in constant motion. As lugs 28 engage the block, block 38 is pulled along guide rails 30 and 32 away from block 39 which is confined in slots 76 of separator plate 74. The tubes are separated by the separation of the interdigitated protrusions 48.

After the separation, block 38 engages ejector cam 80 and the tubes 78 are released from protrusions 48. The unloaded block continues to be driven by drive chains 20 and 22 around sprockets 16 and 18. The driven block then engages actuator 104 which disengages separator plate 74 from prongs 58 of block 39.

The operator then moves a second loaded pair of blocks to the ready position and the separation process is repeated as often as desired. The only difference between the first separation process and succeeding separation processes is that block 39(*a*) of the preceding cycle is pushed by block 38 and both blocks engage the ejector cam, releasing individual tubes 78.

The blocks after engaging actuator 104 are driven around by drive chains 20 and 22 back to the magazine section 61 where the blocks may be used again. The friction brake 81 slows down the blocks as block 38 disengages from drive chains 20 and 22 to minimize the intensity of any collisions between the moving blocks and resting blocks in magazine 61.

If for any reason the drive chains need to be stopped, slowed or reversed in direction or moved just a certain distance, the operator may operate control unit 83 which is located within an arm's reach from the loading position.

In the above manner, the present invention provides for an economical and expeditious manner to separate tubular groups into individual tubes. The operator need only be positioned at a convenient place to load the joined tubes onto the protrusions. He need not manually tear the group apart nor run to various other positions to unload the tubes or reload the tubes. He need not put his hands and arms in danger because there is no need to feed the tubes to operating cutters but only onto a stationary block. The tube separator operates once the blocks are loaded without further assistance from the operator.

It should be understood that the foregoing embodiment of the invention is merely illustrative of the preferred practice of the invention and that various changes and modifications may be made in the arrangements and details of construction of the embodiment described herein without departing from the spirit and scope of the invention.

The embodiments of the invention in which an exclusive property or privilege is claimed are defined as follows:

1. An apparatus comprising:

a first separator element having a plurality of toothed extensions on a side edge;

a second separator element having a plurality of toothed extensions on a side edge;

the second toothed extensions interdigitating with first toothed extensions;

fastening elements extending from a front portion of the toothed extensions; and separation means for separating the first separator element from the second separator element a sufficient distance to separate a group of joined tubes into two sets of tubes.

2. An apparatus as described in claim 1 wherein the fastening elements are protrusions extending frontwardly and horizontally; the protrusions are linearly aligned and substantially parallel to each other; the protrusions are sufficiently long to securely be positioned within end apertures of a group of joined tubes and securely engage the group of joined tubes.

3. An apparatus as described in claim 2 wherein:

the toothed extensions are of uniform size;

the separator elements have aligned planar front surfaces, and aligned top and bottom surfaces;

the protrusions extend perpendicularly from the front surfaces of the toothed extension of separator elements.

4. An apparatus as described in claim 2 wherein a single protrusion extends frontwardly from a single toothed extension, the protrusions are alternately connected to either the first or second separator element and are vertically aligned.

5. An apparatus as described in claim 1 wherein separation means include:

a structural frame;

guide means mounted on the frame engaging the first and second separator elements for maintaining the separator elements in an upright position and for guiding the elements as they separate from one another;

driving means mounted on the frame engaging the first separator element for driving the same along said guide means:

locking means mounted on the frame engaging the second separator element for holding the same in fixed position relative to the guide means.

6. An apparatus as described in claim 5 wherein guide means include at least one guide rail; and the separator element has extensions engaging the guide rail for maintaining the separator element adjacent to the guide rail and allowing movement of the separator element along the guide rail.

7. An apparatus as described in claim 6 wherein the guide rail has a channel running the length of the guide rail and facing the separator elements; and the separator element extensions are rollers engaging the channel in the guide rail.

8. An apparatus as described in claim 7 wherein the guide rail has flat surfaces, one of said flat surfaces has the channel running therethrough; and the separator element has at least one roller engaging the said flat surface outside of the channel.

9. An apparatus as described in claim 5 wherein drive means includes a drive chain having at least one lug extending outwardly, engagement means to connect to the first separator element and extend toward the drive chain a sufficient distance for engaging a lug of the drive chain.

10. An apparatus as described in claim 9 wherein:

a motor means mounted on the frame is operatively connected to a sprocket wheel for turning the sprocket wheel;

a free sprocket wheel is rotatably mounted on the frame at a sufficient distance away from motor driven sprocket wheel;

the free sprocket wheel engages the drive chain wherein the two sprocket wheels train the chain around two curved portions; and the drive chain is endless and continuous having an elongated loop configuration with relatively long parallel straight portions.

11. An apparatus as described in claim 10 wherein the chain has a portion adjacent to the guide means, and a recessed portion which extends away from the guide means and separator element, the chain lug, when in said recessed portion, is disengaged from the engagement means of the first separator element; and further comprising:

guide roller means for guiding the drive chain through the recessed portion, said guide roller means being rotatably mounted on the frame adjacent the drive chain.

12. An apparatus as described in claim 11 and further comprising means for varying the speed, direction and distance traveled by the drive chain operably connected to the motor means; and brake means mounted on the frame for stopping the separator elements as they are disengaged by the drive chain.

13. An apparatus as described in claim 5 wherein the locking means includes a separator plate slidably mounted on the frame, said separator plate has its plane facing the separator element, at least one prong extends backward from the back side of the second separator element; the separator plate has at least one aperture aligned with the prong, the plate has sliding means for sliding the plate toward and away from the second separator element, the prong is engaged with the aperture when the separator plate is toward the separator element and is disengaged when the separator plate is away from the separator element, the second separator element when engaged with the separator plate is fixed with respect to the plate and resists pulling forces exerted by driving means and first separator element on said second separator element.

14. An apparatus as described in claim 5 wherein the actuator and deactuator means are mounted on the guide means for controlling respectively the engagement and disengagement of the locking means with the second separator element;

the first separator element has engaging means for engaging with said actuator means and deactuator means when the first separator element comes within close proximity respectively to the actuator and deactuator means along the guide means;

the engaging means actuates the actuator means to engage the locking means with the second separator element when the engaging means engages said actuator means;

the engaging means actuates the deactuator means to disengage the locking means from the second separator element when the engaging means engages said deactuator means; and the engaging means engages the deactuator means at a sufficient distance from the second separator element to allow the fastening elements to be substantially separated.

15. An apparatus as described in claim 5 and further comprising a securing means for securing the second separator element in a fixed postion relative to the frame when the first separator element is disengaged from the drive means and is adjacent the second separator element for attachment of a group of joined tubes to the fastening elements.

16. An apparatus as described in claim 15 further comprising delivery means mounted on the frame for automatically sliding a pair of the separator elements consisting of a first and a second separator element with interdigitated fastening elements to a position along the guide means so as to be engaged by the securing means; and a second delivery means mounted on the frame for automatically sliding the pair of separator elements to a position along the guide means so the second separator element is engaged by the locking means and the first separator element is engaged by the driving means.

17. An apparatus as described in claim 16 wherein each delivery includes an air operated cylinder having an extendible rod; said rod has a spring loaded lug at its outer end; a lug is attached to the second separator element and extends outwardly so as to engage the spring loaded lug;

the spring loaded lugs engage the lug on the second separator element when the spring loaded lugs are moving toward the securing means or locking means.

18. An apparatus as described in claim 15 and further comprising actuator and deactuator means operably connected to the securing means for controlling respectively the engagement and disengagement of the securing means with the second separator element.

19. An apparatus as described in claim 18 wherein:

the actuator means is mounted on the guide means adjacent to the securing means for controlling the engagement of the securing means with the second separator element;

the first separator element has engaging means for engaging the actuator means when the first separator element comes within close proximity to the actuator means along the guide means;

the engaging means actuates the actuator means to engage the securing means with the second separator element when the engaging means engages said actuator means;

the deactuator means is mounted within reach of an operator such that the operator can manually actuate the deactuating means to disengage the securing means from the second separator element.

20. An apparatus as described in claim 11 and further comprising a securing means for securing at least one of the separator elements in a fixed position relative to the frame when the first separator element is disengaged from the drive means and is adjacent the second separator element for attachment of a group of joined tubes to the fastening elements, and securing means includes a plate slidably mounted on the frame;

the plate is positioned at the recessed position of the drive chain;

said securing plate having its plane facing the separator elements;

the securing plate has an adjacent and remote position with respect to the separator element; and at least one of the separator elements engages the securing plate when the plate is in the adjacent position.

21. An apparatus as described in claim 5 further comprising a removing means for removing the tubes from the first and second separator elements after engagement with the separation means.

22. An apparatus as described in claim 21 wherein:

the fastening elements are protrusions extending frontwardly and horizontally;

the protrusions are linearly aligned and parallel to each other, the protrusions are sufficiently long to securely position end apertures of a group of joined tubes;

the removing means includes:

an ejector plate forming a front surface of each separator element and having apertures therethrough to allow the protrusions to extend outwardly therethrough;

at least one support rod mounted on the ejector plate extending rearwardly and slidably mounted onto the separator element;

a back bar transversely connected to the support rod;

a compressible spring mounted around the one support rod between the transverse back bar and a back surface of each separator element;

a depressing means for engaging and depressing the back bar whereby pushing slidable support rods extend the ejector plate forward and away from each separator element; and the front surface of the ejector plate is extendible to the outermost point of the protrusions.

23. An apparatus as described in claim 22 wherein the depressing means include an ejector cam mounted on the structural frame a sufficient distance from the holding means adjacent to the guide means; the back bar of the separator element is depressed by the ejector cam when the separator element slides by thereto.

24. An apparatus for separating a linear array of joined tubes comprising:

a first group of separator elements having a plurality of protrusions extending therefrom;

a second group of separator elements having a plurality of protrusions extending therefrom;

the protrusions of the first group of separator elements interdigitating with the protrusion of the second group of separator elements such that the protrusions can extend into the open ends of the linear array joined tubes;

separation means for separating the first group of separator elements from the second group of separator elements a sufficient distance to separate the array of joined tubes into two sets of separated tubes.

* * * * *